US009839341B2

(12) United States Patent
Greco

(10) Patent No.: US 9,839,341 B2
(45) Date of Patent: Dec. 12, 2017

(54) FOOD WASTE COLLECTOR SYSTEM WITH OVERHEAD SPRAYER

(71) Applicant: Emerson Electric Co., St. Louis, MO (US)

(72) Inventor: Robert A. Greco, Racine, WI (US)

(73) Assignee: Emerson Electric Co., St. Louis, MO (US)

( * ) Notice: Subject to any disclaimer, the term of this patent is extended or adjusted under 35 U.S.C. 154(b) by 11 days.

(21) Appl. No.: 14/852,652

(22) Filed: Sep. 14, 2015

(65) Prior Publication Data

US 2016/0073850 A1 Mar. 17, 2016

Related U.S. Application Data

(60) Provisional application No. 62/051,370, filed on Sep. 17, 2014.

(51) Int. Cl.

| | |
|---|---|
| ***A47L 15/42*** | (2006.01) |
| ***E03C 1/266*** | (2006.01) |
| *E03B 1/04* | (2006.01) |

(52) U.S. Cl.

CPC ..... *A47L 15/4206* (2013.01); *A47L 15/4219* (2013.01); *A47L 15/4225* (2013.01); *A47L 15/4278* (2013.01); *E03C 1/2665* (2013.01); *E03B 2001/045* (2013.01)

(58) Field of Classification Search

None

See application file for complete search history.

(56) References Cited

U.S. PATENT DOCUMENTS

| | | | | |
|---|---|---|---|---|
| 2,676,759 A * | 4/1954 | Strehlow | A47L 15/00 134/104.4 |
| 2,753,571 A * | 7/1956 | Draper | E03C 1/2665 241/46.016 |
| 4,232,407 A * | 11/1980 | Williams | E03C 1/262 4/286 |
| 4,812,237 A * | 3/1989 | Cawley | C02F 1/048 210/605 |

(Continued)

FOREIGN PATENT DOCUMENTS

| | | |
|---|---|---|
| FR | 2368585 A1 | 5/1978 |
| GB | 2406804 A | 4/2005 |

OTHER PUBLICATIONS

Kraus Installation Manual: Single Level Pull-Out Kitchen Faucet copyright 2013-2014.*

(Continued)

*Primary Examiner* — Michael Kornakov
*Assistant Examiner* — Cristi Tate-Sims
(74) *Attorney, Agent, or Firm* — Harness, Dickey & Pierce, P.L.C.

(57) ABSTRACT

A food waste collector system has a tank, a pump that recirculates water by pumping it from the tank through a spout that discharges into the top of the tank, and an overhead sprayer. The overhead sprayer has a nozzle fluidly coupled by a fresh water valve to a fresh water passage of a water line and by a recirculating water valve to a recirculating water passage of the water line. The overhead sprayer also has a valve handle disposed at the nozzle and coupled to the fresh water valve and the recirculating water valve.

8 Claims, 2 Drawing Sheets

(56) References Cited

U.S. PATENT DOCUMENTS

Figure 1:
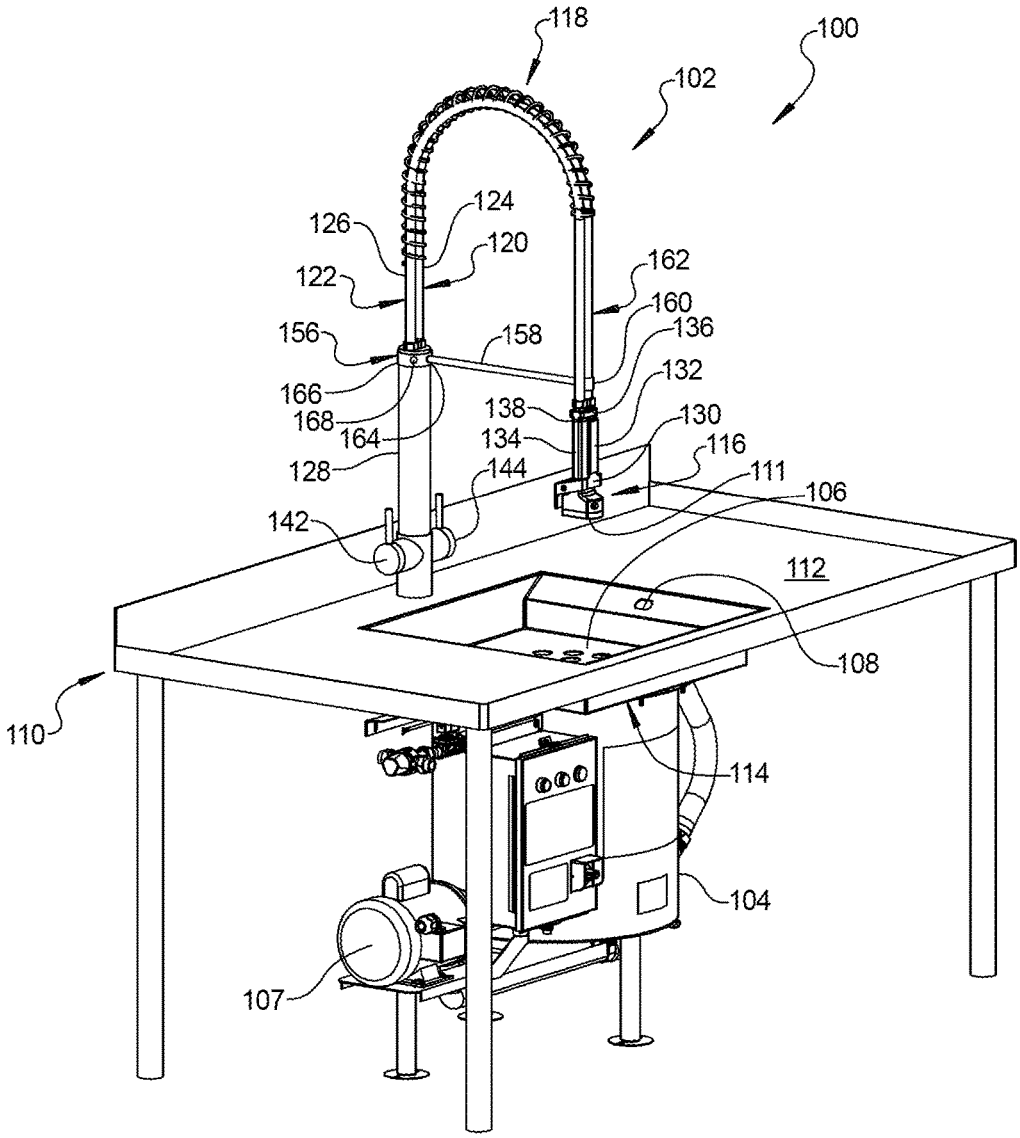

| | | | | |
|---|---|---|---|---|
| 5,971,303 | A * | 10/1999 | Pugh-Gottlieb | E03B 1/044 241/101.2 |
| 2006/0273198 | A1* | 12/2006 | Katz | A47L 15/0065 239/279 |
| 2008/0178935 | A1* | 7/2008 | Thomas | E03C 1/023 137/1 |

OTHER PUBLICATIONS

Notification of Transmittal of the International Search Report and Written Opinion of the International Searching Authority for PCT/US2015/050338 dated Feb. 2, 2016.

* cited by examiner

FOOD WASTE COLLECTOR SYSTEM WITH OVERHEAD SPRAYER

CROSS-REFERENCE TO RELATED APPLICATIONS

This application claims the benefit of U.S. Provisional Application No. 62/051,370 filed on Sep. 17, 2014. The entire disclosure of the above application is incorporated herein by reference.

FIELD

The present disclosure relates to food waste collector systems, and more particularly, to a food waste collector system having an overhead sprayer that provides for use of both fresh and recirculated water.

BACKGROUND

This section provides background information related to the present disclosure which is not necessarily prior art.

Food waste collector systems are typically used in commercial kitchens in lieu of food waste disposers. In a typical prior art food waste collector system, a recirculating stream of warm water (for example, 107° F.) is used to rinse food waste from plates prior to dishwashing. The food waste is collected in a perforated container (such as a strainer basket) that is received in the recirculation tank for the recirculating stream of water. Water in the recirculation tank is pumped by a pump to a spout that is disposed above the recirculation tank and discharges into it. The dishes are held under the spout and rinsed by the water being discharged from the spout. The perforated container can be removed from the recirculation tank, drained and the food waste collected in it emptied.

SUMMARY

This section provides a general summary of the disclosure, and is not a comprehensive disclosure of its full scope or all of its features.

A food waste collector system has a tank mounted to a table with a table top surrounding a top of the tank, a pump that recirculates water by pumping it from the tank and back into the tank through a spout that discharges into the top of the tank, and an overhead sprayer. A perforated container is removably receivable in the tank. The overhead sprayer has a nozzle fluidly coupled by a fresh water valve to a fresh water passage of a water line and by a recirculating water valve to a recirculating water passage of the water line. The overhead sprayer also has a valve handle disposed at the nozzle and coupled to the fresh water valve and the recirculating water valve. The valve handle has a fresh water position wherein the fresh water valve is open and the recirculating water valve is closed when the valve handle is in the fresh water position. The valve handle also has a recirculating water position wherein the recirculating water valve is open and the fresh water valve is closed when the valve handle is in the recirculating water position.

In an aspect, the valve handle is biased to the recirculating water position.

In an aspect, the recirculating water passage is fluidly coupled by a recirculating water shut-off valve to the pump.

In an aspect, the fresh water passage is fluidly coupled to sources of fresh hot and cold water by a mixing valve.

In an aspect, the food waste collector system includes an adjustable nozzle lock for adjustably positioning a vertical height of the nozzle. In an aspect, the adjustable nozzle lock includes a collar slidably received on a vertical member projecting upwardly from the top of a table and a member that is coupled to the collar and to a nozzle side of the water line.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 2:
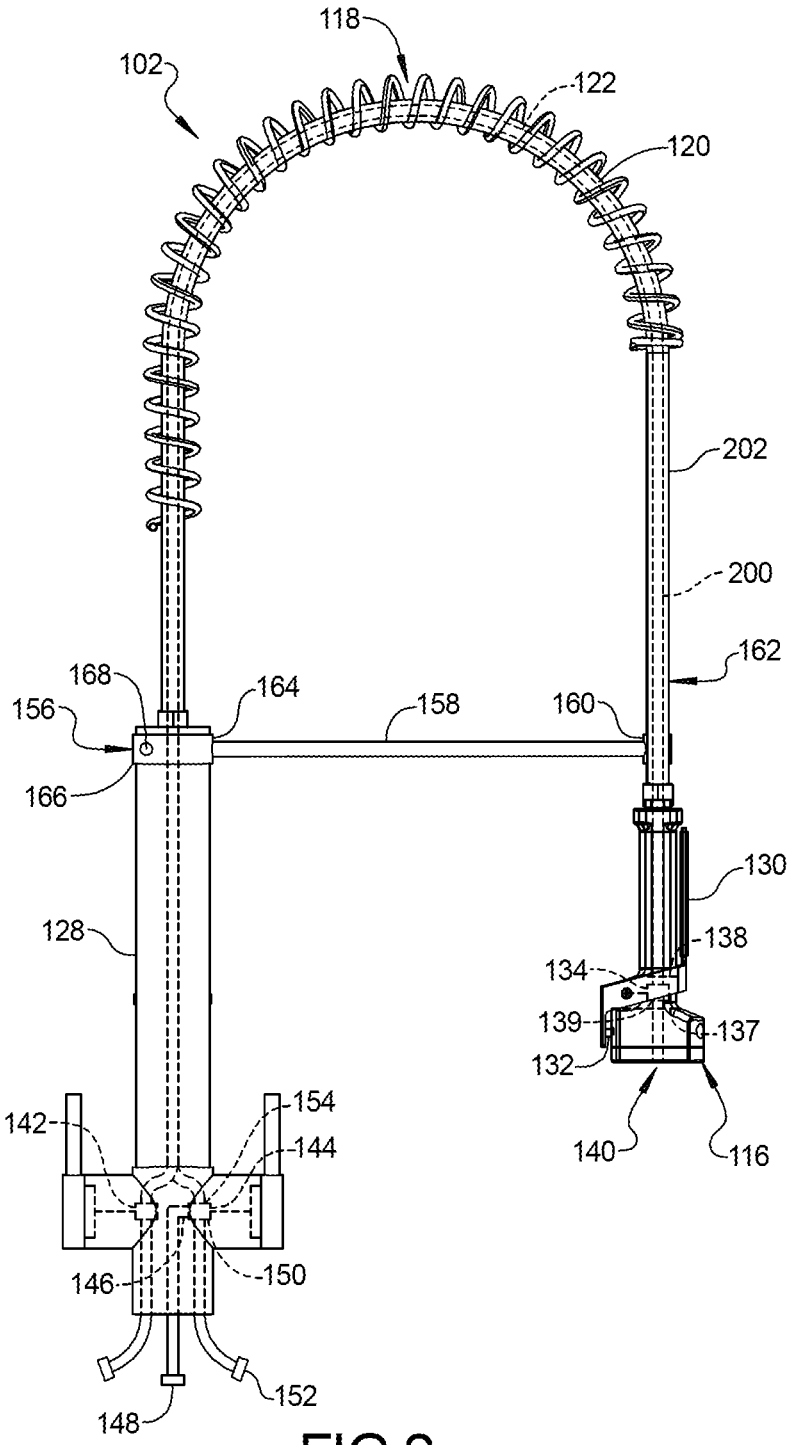

FIG. 1 is a perspective view of a food waste collector system having an overhead sprayer in accordance with an aspect of the present disclosure; and FIG. 2 is a cross-sectional view of a variation of an overhead sprayer of the food waste collector system of FIG. 1.

Corresponding reference numerals indicate corresponding parts throughout the several views of the drawings.

DETAILED DESCRIPTION

With reference to the drawings, a food waste collector system 100 having an overhead sprayer 102 in accordance with an aspect of the present disclosure includes a tank 104, a perforated container 106 removably receivable in the tank 104, a pump 107, and a spout 108. The tank 104 is mounted to a table 110 with a table top 112 surrounding a top 114 of tank 104. Water is recirculated from the tank 104 by being pumped by the pump 107 to the spout 108 where the recirculating water is discharged from the spout 108 into the perforated container 106 (when it is received in the tank 104) and the tank 104. The spout 108 is illustratively a waterfall spout. Overhead sprayer 102 has a nozzle 116 coupled via a water line 118 to a source of fresh water and to a source of the recirculating water.

The water line includes a fresh water passage 120 and a recirculating water passage 122. It should be understood that fresh water passage 120 and recirculating water passage 122 may be individual water lines disposed adjacent each other (such as tubes), shown as fresh water line 124 and recirculating water line 126 in the example embodiment of FIG. 1. In an aspect, a vertical member 128, which may be a cylinder, projects upwardly from table top 112 and surrounds a section of fresh water line 124 and a section of recirculating water line 126.

A valve handle 130 at the nozzle 116 is coupled to a fresh water valve 132 and a recirculating water valve 134. The nozzle 116 is fluidly coupled by the fresh water valve 132 to the fresh water passage 120 and by the recirculating water valve 134 to the recirculating water passage 122. An inlet 136 of the fresh water valve 132 is coupled to the fresh water passage 120 of the water line 118 and an outlet 137 (FIG. 2) of the fresh water valve 132 is coupled to an outlet 140 of the nozzle 116. An inlet 138 of the recirculating water valve 134 is coupled to the recirculating water passage 122 of the water line 118 and an outlet 139 of the recirculating water valve 134 is coupled to the outlet 140 of the nozzle 116. When the valve handle 130 is moved to a fresh water position, the fresh water valve 132 is open and the recirculating water valve 134 is closed, blocking flow of recirculating water out of the nozzle 116. Fresh water then flows through the fresh water valve 132 out through the nozzle 116. When the valve handle 130 is moved to a recirculating water position, the recirculating water valve 134 is open and the fresh water valve 132 is closed, blocking flow of fresh water out through the nozzle 116. Recirculating water then flows through the recirculating water valve 134 out through the nozzle 116. It should be understood that the fresh water valve 132 and the recirculating water valve 134 can be separate valves, or be part of the same valve assembly that includes both valves. In either case, the valve handle 130 is used to move the fresh water valve 132 and the recirculating water valve 134 between their open and closed positions.

By moving the valve handle 130 to the desired position, a user can use the overhead sprayer 102 to spray either fresh water or recirculating water. In an aspect, valve handle 130 is spring loaded so that it is biased by a spring to a desired position—one of the fresh water or recirculating water positions. In an aspect, the desired position is the recirculating water position. A user then grasps the valve handle 130 and pulls it against the spring to move it to the fresh water position. When the user releases the valve handle 130, it then returns to the recirculating water position.

It should be understood that the water line 118 can have other configurations. In an aspect, the water line 118 has an inner tube 200 (FIG. 2) surrounded by an outer tube 202. The inside of the inner tube provides the recirculating water passage 122 and the space between the outer tube 202 and the inner tube 200 provides the fresh water passage 120.

In an aspect, the inside diameter of the inner tube 200 is large enough to allow relatively large particles to pass, such as particles of food waste that may not have been filtered from the recirculating water. In an aspect, the inside diameter of the inner tube 200 is 5/16 of an inch. It should be understood that the inside diameter of the inner tube 200 can be other than 5/16 of an inch.

The recirculating water passage 122 is fluidly coupled by a recirculating water shut-off valve 142 to pump 107. More specifically, recirculating water shut-off valve 142 is coupled between the source of recirculating water, such as an outlet of pump 107, and the recirculating water passage 122. When the recirculating water shut-off valve 142 is closed, recirculating water is blocked from flowing into the recirculating water passage 122 of the water line 118 and all the recirculating water flows to the spout 108. When the recirculating water shut-off valve 142 is open, a portion of the recirculating water flows into the recirculating water passage 122 of the water line 118 and the remainder of the recirculating water flows to the spout 108.

In an aspect, the fresh water passage 120 is fluidly coupled to sources of fresh hot and cold water by a mixing valve 144. More specifically, mixing valve 144 has a hot water inlet 146 coupled to a source of hot water shown representatively by hot water source line 148 (which can be a hot water line of a building in which food waste collector system is located) and a cold water inlet 150 coupled to a source of cold water shown representatively by cold water source line 152 (which can be a cold water line of a building in which food waste collector system 100 is located). An outlet 154 of the mixing valve 144 is coupled to the fresh water passage 120. The mixing valve 144 mixes hot and cold fresh water and is adjustable so that a user can adjust the temperature of the fresh water being sprayed from the nozzle 116.

It should be understood that the mixing valve 144 is optional. If the overhead sprayer 102 does not have mixing valve 144, the fresh water passage 120 is coupled directly to the source of fresh water, which can be either hot water or cold water depending on whether hot or cold water is desired.

The overhead sprayer also includes an adjustable nozzle lock 156 that can be adjusted up and down to adjust the height of the nozzle 116 and then locked in place. In an aspect, adjustable nozzle lock 156 includes a member 158, such as bar or tube, that is attached at one end referred to as nozzle end 160 to a nozzle side 162 of water line 118 above nozzle 116 and at an opposite end referred to as collar end 164 to a collar 166 that is slidably received on vertical member 128. Collar 166 includes a lock device 168 that locks collar in place on vertical member 128. Lock device 168 may for example be a set screw. It should be understood that member 158 could be attached to nozzle 116 instead of water line 118 and as used herein, nozzle side 162 of water line 118 also includes nozzle 116. It should be understood that lock device 168 can be lock devices other than a set screw. Lock device 168 for example can be a clamp. Alternatively, member 158 could skew, such as by the action of a spring force pulling nozzle end 160 upwardly, and create an interference between collar 166 and vertical member 128. Friction then holds collar 166 in position on vertical member 128. Member 158 is then moved to be perpendicular to vertical member 128 to release the interference between collar 166 and vertical member 128, collar 166 is then slid up or down on vertical member 128 to position collar 166 and thus the height of nozzle 116, and member 158 then released to return to the skewed position recreating the interference between collar 166 and vertical member 128.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A food waste collector system, comprising:

a tank mounted to a table with a table top surrounding a top of the tank;

a perforated container removably receivable in the tank in which food waste introduced into the tank is collected;

a pump that recirculates water by pumping it from the tank through a spout that discharges into the top of the tank; and an overhead sprayer having a nozzle fluidly coupled by a fresh water valve to a fresh water passage of a water line and by a recirculating water valve to a recirculating water passage of the water line; and a valve handle disposed at the nozzle and coupled to the fresh water valve and the recirculating water valve, the valve handle having:

a fresh water position wherein the fresh water valve is open and the recirculating water valve is closed when the valve handle is in the fresh water position; and a recirculating water position wherein the recirculating water valve is open and the fresh water valve is closed when the valve handle is in the recirculating water position.

2. The food waste collector system of claim 1 wherein the valve handle is biased to the recirculating water position.

3. The food waste collector system of claim 1 wherein the recirculating water passage is fluidly coupled by a recirculating water shut-off valve to the pump.

4. The food waste collector system of claim 3 wherein the fresh water passage is fluidly coupled to sources of fresh hot and cold water by a mixing valve.

5. The food waste collector system of claim 1 including an adjustable nozzle lock for adjustably positioning a vertical height of the nozzle.

6. The food waste collector system of claim 5 wherein the adjustable nozzle lock includes a collar slidably received on a vertical member projecting upwardly from the top of a table and a member that is coupled to the collar and to a nozzle side of the water line.

7. The food waste collector system of claim 1 wherein fresh water valve and the recirculating water valve are included in a single valve assembly.

8. The food waste collector system of claim 1 further including a recirculating water shut-off valve coupled between the pump and the spout and also between the pump and the recirculating water passage wherein when the recirculating water shut-off valve is in closed recirculating water is blocked from flowing into the recirculating water passage and all recirculating water from the pump flows to the spout and wherein when the recirculating water shut-off valve is open a portion of recirculating water flows from the pump to the recirculating water passage and a remainder of the recirculating water flows from the pump to the spout.

* * * * *